33-261 SR
1/13/81 XR 4,244,115

United States Patent [19]

Waldorf

[11] 4,244,115

[45] Jan. 13, 1981

[54] BOW SIGHT

[76] Inventor: Alvin Waldorf, 8899 Amsden, Fenwick, Mich. 48834

[21] Appl. No.: 45,254

[22] Filed: Jun. 4, 1979

[51] Int. Cl.[3] ..... F41G 1/46
[52] U.S. Cl. ..... 33/265; 33/261
[58] Field of Search ..... 33/265, 277, 255, 42, 33/254, 261

[56] References Cited

U.S. PATENT DOCUMENTS

| | | | |
|---|---|---|---|
| 1,185,183 | 5/1916 | Derse | 33/255 |
| 1,277,191 | 8/1918 | Butler | 33/277 |
| 3,234,651 | 2/1966 | Rivers | 33/265 |
| 3,590,489 | 7/1971 | Saunders | 33/265 |
| 3,811,195 | 5/1974 | Carella | 33/265 |
| 3,875,674 | 4/1975 | Davidson | 33/265 |
| 4,116,194 | 9/1978 | Topel | 33/265 |

*Primary Examiner*—William D. Martin, Jr.

*Attorney, Agent, or Firm*—John A. Waters

[57] ABSTRACT

A sighting mechanism for a bow comprises a one-piece wire sight guide slideably mounted for transverse movement in a mounting block that is adapted to be attached to a bow. The sight guide includes a central section that runs parallel to the plane of the bow, and a series of annular grooves are formed along the central section. A plurality of flat, plastic discs are slideably mounted on the central section, with the openings in the discs being slightly smaller than the diameter of the central section such that the discs can be clipped securely into any selected groove along the central section. The central section serves as a vertical reference line and the discs serve as horizontal reference lines for sighting purposes. A number of different discs are employed for the different horizontal reference lines necessary for targets at different distances.

10 Claims, 6 Drawing Figures

BOW SIGHT

BACKGROUND OF THE INVENTION

1. Field of the Invention

This invention relates to a bow sight mechanism and more particularly to a bow sight mechanism employing a plurality of horizontal reference lines that can be easily adjusted.

2. Description of the Prior Art

Most bows employed in archery hunting do not come equipped with any mechanism for sighting the bow on its desired target. Accordingly, there are a number of different types of sights that have been developed that can be attached to an existing bow. Such sights generally are attached to a portion of the bow above the handgrip and include some type of mechanism projecting into the line of sight of the archer so that the archer can have a reference point for sighting the bow. Typically such a sight will include a series of horizontal reference lines or points for aiming the bow for targets at different distances. Since the trajectory of an arrow must be substantially greater for a distant target than for a close target, the bow must be aimed substantially higher for the distant target. A series of horizontal reference lines are employed for targets at varying distances, such as ten, twenty, and thirty yards.

One of the drawbacks with the bow sights previously developed is that they are generally complex and expensive.

It is one of the principle objects of the present invention to provide an effective, easy to adjust bow sight that is of an uncomplicated and inexpensive construction but is simple and easy to install and use.

SUMMARY OF THE INVENTION

In accordance with the present invention, a sighting mechanism for a bow comprises an elongated rod having a series of grooves spaced at predetermined distances along the rod and flat, resilient vertical position markers having openings therein that fit snugly over the rod. The openings in the vertical position markers are of a size such that the position markers clip securely into place in the grooved sections along the rod, the position markers being movable to other grooved sections to adjust the height setting of the bow sight. A mounting mechanism attached to the bow holds the elongated rod such that the elongated rod provides a generally vertical reference line and the position markers provide generally horizontal reference lines for sighting the bow.

The elongated rod of the present invention comprises a central section of a wire sight guide which includes upper and lower sections at each end of the elongated rod that extend inwardly toward the bow. The upper and lower sections fit into transverse openings in a mounting block attached to the bow. The mounting block includes set screw clamping mechanisms that permit the wire sight guide to be moved inwardly and outwardly with respect to the bow but can be tightened to secure the sight guide in any lateral position.

The mounting block can be affixed to the bow by means of a pressure sensitive adhesive backing on which the mounting block is mounted. Alternatively, a mounting plate on the side of the bow can be employed, with the mounting block being screwed or otherwise attached to the mounting plate.

These and other features and advantages of the present invention hereinafter appear, and, for purposes of illustration but not of limitation, a preferred embodiment of the present invention is described in detail below and shown in the appended drawings.

DETAILED DESCRIPTION OF THE PREFERRED EMBODIMENT

Figure 1:
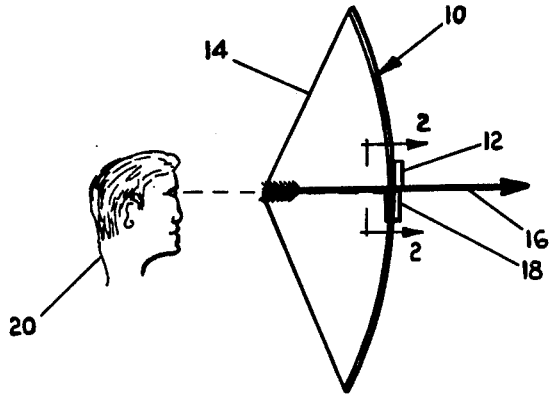
FIG. 1 is a pictorial view showing the manner in which a sight guide of the present invention is employed in sighting a bow.

Referring now to the drawings, a bow 10 employing the bow sight 12 of the present invention is shown in FIG. 1. Bow 10 is shown with the bow string 14 drawn back and an arrow 16 in position to shoot. The arrow rests on a handgrip 18 and rides just under the bow sight such that the bow sight lies in the line of sight of an archer 20 employing the bow.

Figure 3:
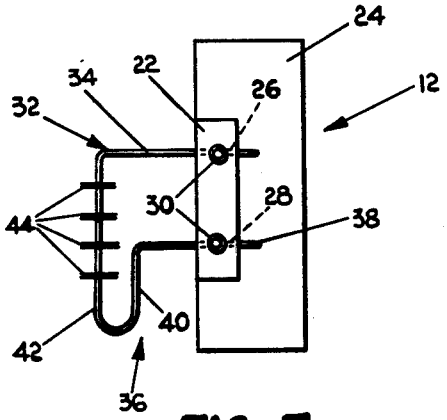
FIG. 3 is a front elevational view of the bow sight of the present invention.

As shown in FIG. 3, bow sight 12 comprises a mounting block 22 formed of a rigid plastic material or the like attached to a flexible backing material 24. Backing material 24 is formed of a flexible material such as 1/16 inch plastic sheet and is provided with a pressure sensitive adhesive backing. Mounting block 22 includes a pair of transverse openings 26 and 28. Hand operated set screws 30 extend at right angles to the openings through the mounting blocks such that the set screws can be used as a clamping mechanism to clamp a sight guide 32 at a selected lateral position in the mounting block.

Desirably, mounting block 22 is formed of a molded plastic material and is either welded to or integrally formed with the flexible backing material, with the pressure sensitive adhesive on the backing material being the type that has a peel off backing. The backing material is formed of a thin, preferably 1/16 inch plastic sheet, so that you can cut the backing material to fit the shape of the bow. As shown in FIG. 1, the bow sight desirably is attached to the front side of the bow (the right hand side as shown in FIG. 1). As an alternative means for attaching the bow sight to the bow, rather than peeling off the backing, the bow sight can be taped to the bow. This permits the bow sight to be removed easily for application with another bow.

The alignment mechanism of the bow sight is provided by a wire sight guide 32. Wire sight guide 32 includes an upper section 34 extending outwardly from mounting block 22 and a lower section 36 also extending outwardly from mounting block 32. Lower section 36 includes a first segment 38 that runs parallel to upper section 34 and then a downwardly extending section 40 that extends downwardly then outwardly in the manner shown in FIG. 3. A central section or elongated rod 42 extends between the outer ends of upper and lower sections 34 and 36. Elongated rod 42 serves as a vertical reference line for sighting the bow.

The entire wire sight guide is preferably formed of a relatively thin rod or wire of medium hardness and preferably including a plating to prevent rust. Desirably the rod should be approximately 3/32–1.8 inch in diameter.

Elongated rod 42 includes a series of vertical position markers 44 in the form of resilient plastic or nylon discs. To accommodate these discs, rod 42 is provided with a series of spaced grooves around the outer periphery thereof. Desirably there are approximately twenty grooves in a two-inch space along the rod, with approximately forty thousandths of an inch separating each groove. The grooves themselves are approximately sixty thousandths of an inch in width.

Figure 4:
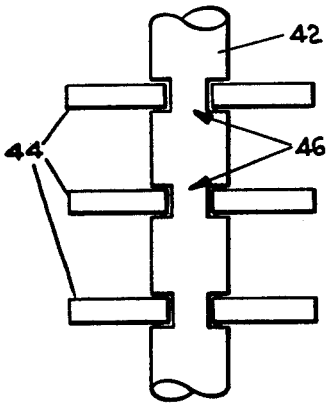
FIG. 4 is a broken view showing the elongated rod and plastic discs of the bow sight of the present invention.
Figure 5:
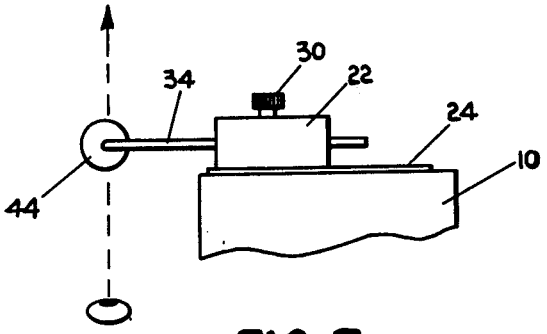
FIG. 5 is a view taken along line 5—5 of FIG. 2.

Resilient plastic discs 44 desirably are round so that the discs can be placed in any radial position on the rod. The discs include central openings 46 therein that are shaped such that the discs snugly fit over the rod and clip securely into the grooves in the rod in the manner shown in FIG. 4. To accomplish this, the diameter of the opening in each disc is slightly smaller than the outer diameter of the rod but is slightly larger than the diameter of the groove in the rod. The grooves are fairly shallow so that the disc can be moved relatively easily from groove to groove to adjust the vertical alignment of the sight.

Figure 2:
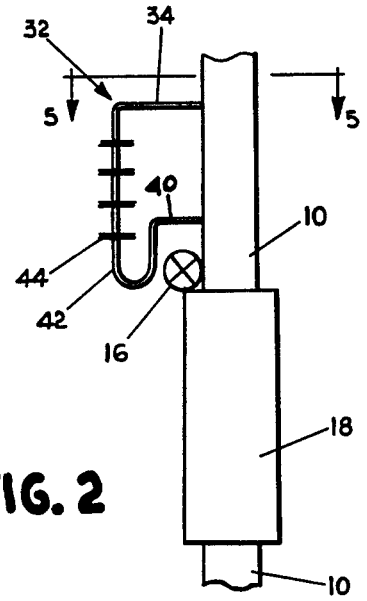
FIG. 2 is a partially broken view taken along line 2—2 of FIG. 1.

A plurality of discs are employed in the bow sight of the present invention in order to provide for different arrow trajectories for targets at different distances. For example, the four discs shown in FIGS. 2 and 3 could be employed for targets at distances of twenty yards, forty yards, sixty yards, and eighty yards, with the upper disc being aligned with a target twenty yards away and the lower disc being aligned with a target eighty yards away. The proper disc position for each archer and each bow is determined separately by a simple trial and error proceedure.

Figure 6:
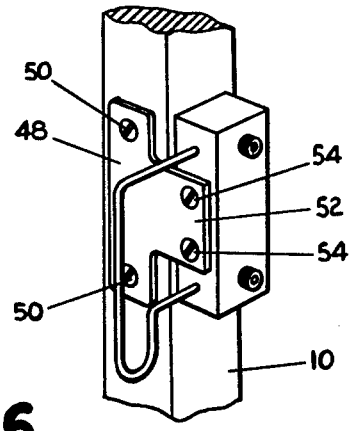
FIG. 6 is a perspective view showing the bow sight of the present invention mounted to a bow by means of a mounting plate attached to the side of the bow.

Another means for attaching the bow sight of the present invention to a bow as shown in FIG. 6, wherein a side plate 48 formed of a relatively rigid plastic material or the like is attached by screws 50 or similar threaded fasteners to the side of the bow. An outer end 52 of the mounting plate extends beyond the surface of the bow and is attached to the side of the mounting block by means of screws or similar threaded fasteners 54.

To employ the present invention with a bow, the backing material is first cut to the shape of the bow and then taped in position on the bow. Alternatively at this point the pressure sensitive adhesive backing could be removed and the backing affixed directly to the bow. The vertical discs are then aligned in the proper grooves by means trial and error. The weight of the arrows, the pull of the bow, and the hunter's shooting characteristics are all individual factors that require individual alignment of each bow sight. Each disc is aligned at a different distance from the archer. The vertical reference line is established by loosening the set screws and moving the sight guide inwardly and outwardly with respect to the mounting block until the correct position is achieved.

After the bow sight has been aligned in this manner, no further alignment is necessary. If the weight of the arrows or other similar factors are changed, the bow can easily be realigned by sliding the discs upwardly and downwardly on the sight guide.

The present invention provides a very simple and inexpensive sighting mechanism for a bow that achieved virtually all of the advantages of far more complex and expensive hardware previously developed.

It should be understood that the foregoing represents merely an exemplary embodiment of the present invention and that various modifications and changes in the arrangements and details of construction of the embodiment disclosed herein may be made without departing from the spirit and scope of the present invention.

The embodiments of an invention in which an exclusive property or privilege is claimed are defined as follows:

1. A sighting mechanism for a bow comprising:

an elongated rod having a series of transverse grooves spaced at predetermined distances along the rod;

flat, resilient vertical position markers having openings therein that fit snugly over the rod, the openings being of a size such that the vertical position markers clip securely into place in the grooves along the rod, the position markers being movable to other grooves to adjust the height setting of the bow sight, the opening in each position marker being formed such that at least a portion of the position marker surrounding the opening is resiliently deflected outwardly by the rod when the position marker is positioned on a non-grooved portion of the rod, said portion of the position marker resiliently deflecting inwardly so as to fit into any desired groove in the rod when the position marker is positioned on the groove, the interfitting of said portion of the position marker in the groove holding the position marker resiliently in its desired vertical position on the rod; and mounting means for mounting the elongated rod to the bow such that the elongated rod provides a generally vertical reference line and the position markers provide generally horizontal reference lines for sighting the bow.

2. A bow sight according to claim 1 wherein the elongated rod comprises a central section of a wire sight guide, the sight guide being a continuous length of wire rod and comprising an upper section that extends inwardly toward the bow from the upper end of the central section, and a lower section that extends inwardly toward the bow from the lower end of the central section, the mounting means being attached to the bow and engaging and holding the upper and lower sections of the sight guide in a fixed position on the bow.

3. A bow sight according to claim 2 wherein the mounting means comprises a mounting block adapted to be attached to the bow, the mounting block having transverse openings in the side thereof through which the upper and lower sections of the sight guide fit, the sight guide being slideable laterally in and out of said openings, the mounting block further including clamp means for releasably holding the sight guide in any desired lateral position in the mounting block.

4. A bow sight according to claim 3 wherein the mounting block is affixed to a flexible backing material and the backing material includes a pressure sensitive adhesive backing means for attaching the mounting block to the bow.

5. A bow sight according to claim 3 wherein the mounting block is mounted on the bow by means of a side piece adapted to be screwed on the side of the bow, the mounting block being attached to or integrally formed as a part of the side piece.

6. A bow sight for a bow comprising:

a mounting block adapted to be attached to the bow, the mounting block having a pair of transverse openings therein, with set screws being threaded in the mounting block so as to protrude into the openings when rotated;

a sight guide formed of wire rod and having upper and lower sections that fit into the transverse openings in the mounting block and a central section that extends between the upper and lower sections, the central section being positioned so as to be generally parallel to and offset from the plane of the bow so as to serve as a vertical reference line for sighting the bow, the sight guide being slideable into and out of the openings in the mounting block and being clampable in a selected lateral position in the mounting block by tightening the set screws, the central section of the sight guide being provided with a plurality of spaced transverse grooves therein; and a plurality of flat, resilient vertical position markers that fit on the central section of the sight guide through openings in the position markers, the markers being shaped and the openings being formed such that the position markers fit snugly on the central section and clip securely into selected grooves in the central section, the position markers serving as horizontal reference lines for various target distances and being movable along the central section to adjust the sight, the opening in each position marker being formed such that at least a portion of the position marker surrounding the opening is resiliently deflected outwardly by the rod when the position marker is positioned on a non-grooved portion of the rod, said portion of the position marker resiliently deflecting inwardly so as to fit into any desired groove in the rod when the position marker is positioned on the groove, the interfitting of said portion of the position marker in the groove holding the position marker resiliently in its desired vertical position on the rod.

7. A bow sight according to claim 1 or 6 wherein the position markers comprise flat disc members formed of a resilient nylon or plastic material.

8. A bow sight according to claim 7 wherein the grooves are annular grooves around the circumference of the rod.

9. A bow sight according to claim 8 wherein the opening in each marker is circular, with the diameter of the opening being less than the diameter of the non-grooved portion of the rod.

10. A bow sight according to claim 9 wherein the diameter of the opening in the marker is at least equal to the diameter of the grooved portion of the rod.

* * * * *